US007668484B2

(12) United States Patent
Kagawa et al.

(10) Patent No.: US 7,668,484 B2
(45) Date of Patent: Feb. 23, 2010

(54) CHARGING ROLLER AND IMAGE FORMING APPARATUS INCORPORATING SAME

(75) Inventors: Toshiaki Kagawa, Kitakatsuragi-gun (JP); Kouji Shinkawa, Kitakatsuragi-gun (JP); Tohru Sakuwa, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 111 days.

(21) Appl. No.: 11/783,152

(22) Filed: Apr. 6, 2007

(65) Prior Publication Data

US 2007/0253737 A1 Nov. 1, 2007

(30) Foreign Application Priority Data

Apr. 28, 2006 (JP) ..... 2006-127061

(51) Int. Cl.
*G03G 15/02* (2006.01)

(52) U.S. Cl. ..... 399/176; 399/100; 399/111

(58) Field of Classification Search ..... None
See application file for complete search history.

(56) References Cited

U.S. PATENT DOCUMENTS

| | | | | |
|---|---|---|---|---|
| 5,321,482 | A | 6/1994 | Yano et al. | |
| 5,589,924 | A | 12/1996 | Yano et al. | |
| 6,311,031 | B1 * | 10/2001 | Hirano | 399/101 |
| 6,391,511 | B1 * | 5/2002 | Okamoto et al. | 430/123.3 |
| 2001/0055687 | A1 | 12/2001 | Hoshi | |
| 2003/0118372 | A1 * | 6/2003 | Kitano et al. | 399/176 |
| 2004/0151997 | A1 * | 8/2004 | Miyamoto et al. | 430/56 |

FOREIGN PATENT DOCUMENTS

| | | |
|---|---|---|
| JP | 5-66698 A | 3/1993 |
| JP | 05-281830 | 10/1993 |
| JP | 2000-066528 | 3/2000 |
| JP | 2000-276001 A | 10/2000 |
| JP | 2000-346051 | 12/2000 |
| JP | 2001-348443 | 12/2001 |
| JP | 2002-040760 | 2/2002 |
| JP | 2002-082514 | 3/2002 |
| JP | 2002-139911 | 5/2002 |
| JP | 2004-45512 | 2/2004 |
| JP | 2004-191960 | 7/2004 |
| JP | 2004-191961 | 7/2004 |
| JP | 2005-043703 | 2/2005 |
| JP | 2005-121982 | 5/2005 |
| JP | 2005-292454 | 10/2005 |
| JP | 2006-039031 | 2/2006 |
| JP | 2006-053544 | 2/2006 |

* cited by examiner

*Primary Examiner*—David M Gray
*Assistant Examiner*—Roy Yi
(74) *Attorney, Agent, or Firm*—Nixon & Vanderhye, PC

(57) ABSTRACT

The invention delivers a charging roller which is capable of preventing current leakage to a photoreceptor throughout lifetime and which has a stable resistance value throughout lifetime. The charging roller contains a metal core and a rubber layer formed on the core. The rubber layer is an epichlorohydrin-based rubber base material to which an electronic conductive agent and an ionic conductive agent are added. The rubber layer is subjected to surface processing by spraying the surface with a solution containing an isocyanate compound and heating. The amount of the electronic conductive agent added to the rubber base material is limited so that a volume resistivity when only the electronic conductive agent is added to the rubber base material is $1.46\times10^{6}$ Ω·cm or greater. In addition, the amount of the added ionic conductive agent is increased so that a volume resistivity when the electronic conductive agent and the ionic conductive agent are added to the rubber base material is $1.93\times10^{6}$ Ω·cm or less.

7 Claims, 4 Drawing Sheets

CHARGING ROLLER AND IMAGE FORMING APPARATUS INCORPORATING SAME

This nonprovisional application claims priority under 35 U.S.C. § 119(a) on Patent Application No. 2006-127061 filed in Japan on Apr. 28, 2006, the entire contents of which are hereby incorporated by reference.

FIELD OF THE INVENTION

The present invention relates to a charging roller, provided in an electrophotographic image forming apparatus, which contacts an image carrier on which an electrostatic latent image will be formed, to electrically charge the image carrier.

BACKGROUND OF THE INVENTION

In the electrophotographic forming of an image, an electrostatic latent image that corresponds to the image is formed on a photoreceptor surface. An electric charging process, in which the photoreceptor surface is uniformly charged, is needed prior to the formation of the electrostatic latent image. The photoreceptor can be charged by one of two schemes: the non-contact charge scheme and the contact charge scheme.

The non-contact charge scheme typically involves the use of a "corotron charger" or a "scorotron charger." These chargers induce corona discharge, which in turn feeds electric charge to the photoreceptor through the air. Since the charger does not contact the photoreceptor in the non-contact charge scheme, the photoreceptor is less likely to be contaminated or wear out, which are advantages of the scheme. On the other hand, the scheme has a problem that the corona discharge entails ozone and other byproducts.

A recent trend which has emerged due to consideration of the environment is contact chargers which do not involve any corona discharge. Some of them employ a rubber member to contact the photoreceptor. The member is shaped-like a roller, and voltage is applied to it. The roller that includes the rubber member is generally called a charging roller.

The charging roller needs to be set up to exhibit a suitable resistance value so that it can uniformly charge the photoreceptor to a desired electric potential, while preventing current leakage from the charging roller to the photoreceptor. To achieve these effects, for example, documents 1, 2 describe a method for controlling the resistance of the rubber member of the charging roller by adding an electrically conductive agent to the rubber member.

Surface processing technology for the rubber member of the charging roller is described in document 3 to 10. The technology disclosed in the patent documents hardens the surface of a rubber layer made of an epichlorohydrin rubber base material by treating the surface with a solvent containing an isocyanate compound to prevent, for example, ionic conductive agent from leaking through the surface.

The conventional charging roller, however, is likely to cause current leakage from the charging roller to the photoreceptor. Another problem is that the resistance of the charging roller can vary over its life-time.

Document 1: Japanese Unexamined Patent Publication (Tokukai) 2005-43703 (published Feb. 17, 2005)

Document 2: Japanese Unexamined Patent Publication (Tokukai) 2005-121982 (published May 12, 2005)

Document 3: Japanese Unexamined Patent Publication 5-281830/1993 (Tokukaihei 5-281830; published Oct. 29, 1993)

Document 4: Japanese Unexamined Patent Publication (Tokukai) 2000-346051 (published Dec. 12, 2000)

Document 5: Japanese Unexamined Patent Publication (Tokukai) 2001-348443 (published Dec. 18, 2001)

Document 6: Japanese Unexamined Patent Publication (Tokukai) 2002-40760 (published Feb. 6, 2002)

Document 7: Japanese Unexamined Patent Publication (Tokukai) 2002-82514 (published Mar. 22, 2002)

Document 8: Japanese Unexamined Patent Publication (Tokukai) 2004-191960 (published Jul. 8, 2004)

Document 9: Japanese Unexamined Patent Publication (Tokukai) 2004-191961 (published Jul. 8, 2004)

Document 10: Japanese Unexamined Patent Publication (Tokukai) 2006-53544 (published Feb. 23, 2006)

SUMMARY OF THE INVENTION

The electrically conductive agent added to the rubber member of the charging roller is broadly divided into two categories. One of them is carbon black, metal oxides, and other electronic conductive agents. The other one is ionic conductive agents. The electronic conductive agent, such as carbon black, introduces, for example, electrically conductive carbon which disperses and stays in the rubber member, which makes the rubber member conductive. The electronic conductive agent has an advantage that it imparts stable conduction regardless of the time period the charging roller is used. On microscopic scales, on the other hand, current tends to concentrate where carbon resides, which can be a cause for current leakage from the charging roller to the photoreceptor.

If an electrically conductive lubricant (ex. zinc stearate) is applied to the photoreceptor surface, the current leakage is especially noticeable due to the effects of the lubricant. Current leakage is preventable to some degrees by surface processing of the rubber member. The effect of the processing is often partly lost through the use of the charging roller. Reliable prevention is difficult.

The ionic conductive agent is less likely to cause current leakage because the ions in the agent's components give uniform charging nature to the rubber member. However, the ions are displaced over the use of the charging roller, which could change the resistance. The displacement of the ionic conductive agent becomes especially noticeable if the charging roller is charged under constant dc voltage. When the internal resistance of the rubber member exceeds the resistance of the most external part of the surface due to these changes, the overall resistance of the charging roller changes.

The rubber member of the conventional charging roller includes only either the electronic conductive agent or the ionic conductive agent, and if the agents are used together, lacks good balance between the agents. Therefore, the rubber member inevitably suffers from one of the foregoing problems.

The present invention, conceived in view of the problems, has an objective of providing a charging roller which, throughout its life-time, is capable of preventing current leakage to an image carrier such as the photoreceptor and has stable resistance.

To achieve the objective, the charging roller in accordance with the present invention is characterized in that a charging roller including a conductive support body and a resistive layer formed on the conductive support body, the resistive layer being formed by hardening a surface of a conductive agent-containing rubber layer formed by adding an electronic conductive agent and an ionic conductive agent to a rubber base material to which no conductive agents have been added and then molding the rubber base material, a first addition amount which is an amount of the electronic conductive agent added to the rubber base material being such that a volume resistivity when only the first addition amount of the electronic conductive agent has been added to the rubber base material is $1.46\times10^6$ Ω·cm or greater, and a second addition amount which is an amount of the ionic conductive agent added to the rubber base material being such that a volume resistivity when the first addition amount of the electronic conductive agent and the second addition amount of the ionic conductive agent have been added to the rubber base material is $1.93\times10^6$ Ω·cm or less.

According to the arrangement, the amount of the added electronic conductive agent is limited in comparison to conventional cases, so that the rubber base material comes to exhibit a volume resistivity of $1.46\times10^6$ Ω·cm or greater when only the electronic conductive agent has been added. If the effect of the surface hardening process is partly lost, the current leakage from the charging roller to the image carrier is still prevented. Meanwhile, the amount of the added ionic conductive agent is increased in comparison to conventional cases, so that the rubber base material comes to exhibit a volume resistivity of $1.93\times10^6$ Ω·cm or less when the ionic conductive agent, as well as the aforementioned amount of the electronic conductive agent, has been added to the rubber base material. Thus, the resistive layer, after the surface hardening process, has a sufficiently lower resistance inside than on the hardened surface. Therefore, even if the ionic conductive agent is somewhat displaced due to the use of the charging roller under constant dc voltage, the internal resistance of the resistive layer does not exceed the resistance on the surface. Therefore, the overall resistance of the charging roller is stable throughout life-time.

The image forming apparatus in accordance with the present invention, to address the problems, is characterized in that the apparatus includes: an image carrier for carrying an electrostatic latent image; and a charging roller for charging the image carrier, the charging roller including a conductive support body and a resistive layer formed on the conductive support body, the resistive layer contacting a surface of the image carrier, the resistive layer being formed by hardening a surface of a conductive agent-containing rubber layer formed by adding an electronic conductive agent and an ionic conductive agent to a rubber base material to which no conductive agents have been added and then molding the rubber base material, a first addition amount which is an amount of the electronic conductive agent added to the rubber base material being such that a volume resistivity when only the first addition amount of the electronic conductive agent has been added to the rubber base material is $1.46\times10^6$ Ω·cm or greater, and a second addition amount which is an amount of the ionic conductive agent added to the rubber base material being such that a volume resistivity when the first addition amount of the electronic conductive agent and the second addition amount of the ionic conductive agent have been added to the rubber base material is $1.93\times10^6$ Ω·cm or less.

According to the arrangement, a charging roller is used which prevents current leakage to the photoreceptor and exhibits a stable resistance value throughout life-time. A good image is thereby formed.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

Embodiments

The following will describe an embodiment of the present invention in reference to FIGS. 1 to 4.

Figure 2:
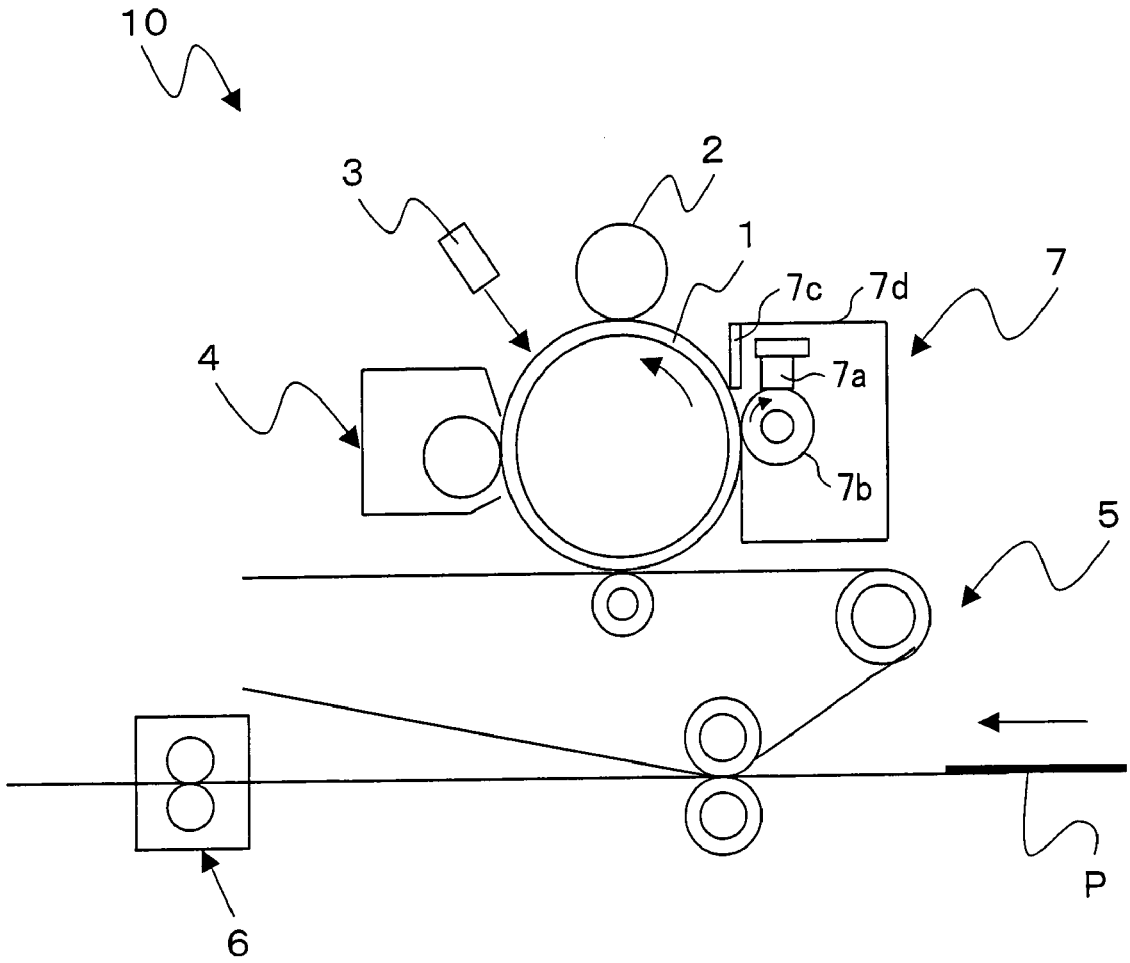
FIG. 2, illustrating an embodiment of the present invention, is a cross-sectional view showing the overall structure of an image forming apparatus.

Referring to FIG. 2, the structure of major features of an image forming apparatus 10 of the present embodiment will be described. FIG. 2 is a vertical cross-sectional view of the image forming apparatus 10 when viewed from the front.

As shown in FIG. 2, the image forming apparatus 10 forms an image represented by image data on a sheet of paper by an electrophotographic scheme. The image forming apparatus 10 contains a photoreceptor (image carrier) 1. Around the photoreceptor 1 are there provided components which perform a well-known Carlson process: namely, a charging roller 2, illumination unit 3, developing unit 4, transfer unit 5, fusing unit 6, and cleaning unit 7.

The photoreceptor 1 is shaped like a drum and supported at its axis by a housing (not shown) in such a way that it is rotatable. The photoreceptor 1 contains a support body having a photosensitive layer being formed on its surface. The support body is made of, for example, an aluminum-based material. The layer is made of, for example, an OPC (organic photoconductor). The drum-shaped photoreceptor 1 may be replaced with a belt-shaped photoreceptor.

The charging roller 2 contacts the surface of the photoreceptor 1 to uniformly charge the surface of the photoreceptor 1 to a desired electric potential. The roller 2 is shaped like a roller. The charging roller 2 is supported at its axis by a housing (not shown) in such a way that it is rotatable. The structure of the charging roller 2 will be described later in detail.

The illumination unit 3 may be an ELD (electroluminescent display), LED (light emitting diode), or like write head in which light emitting elements are arranged in an array. Alternatively, the unit 3 may be a laser scanning unit (LSU) which is equipped with a laser emitting device and a reflection mirror. The illumination unit 3 illuminates the photoreceptor 1 in accordance with the externally supplied image data to form an electrostatic latent image in accordance with the image data on the photoreceptor 1.

The developing unit 4 visualizes (develops) the electrostatic latent image formed on the surface of the photoreceptor 1 with toner, thereby forming a toner image. The transfer unit 5 includes a rotating endless belt supported by a plurality of rollers. In the transfer unit 5, the toner image is transferred first from the photoreceptor 1 to the endless belt and then from the endless belt to paper. A toner image is thus formed on the paper.

The fusing unit 6 presses the paper onto which the toner image has been transferred with a heated roller from both sides of the paper, to fuse the toner image onto the paper.

The cleaning unit 7 cleans the surface of the photoreceptor 1 after the toner image transfer. The cleaning unit 7 contains a lubricant 7*a*, a brush roller 7*b*, and a blade 7*c*, all of which are housed in an enclosure 7*d*.

The blade 7*c* collects the remaining toner on the surface of the photoreceptor 1. The blade 7*c* is made of an elongated rubber member and positioned so that its length is parallel to the axis of the photoreceptor 1. The blade 7*c* is placed so that one of the long sides is located downstream of an opening provided on the enclosure 7*d* in terms of the rotation of the photoreceptor 1 and that the edge of the other long side is in contact with the surface of the photoreceptor 1.

The lubricant 7*a* is applied to the surface of the photoreceptor 1 by the brush roller 7*b*. The lubricant 7*a* is a solid type and has a rectangular parallelepiped shape. The lubricant 7*a* has the same length (width) as the photoreceptor 1 and is positioned so that its length is parallel to the axis of the photoreceptor 1. The lubricant 7*a* is supported by a lubricant holder. The lubricant 7*a* is replaceable if it wears down.

The lubricant 7*a* may be, for example, a metal salt of a fatty acid, known as metal soap, or fluorine resin. Examples of metal salts of fatty acids include zinc stearate, copper stearate, iron stearate, magnesium palmitate, zinc oleate, calcium palmitate, manganese oleate, lead oleate, and other like metal salts of fatty acids with a relatively long chain.

The brush roller 7*b* is tubular and has almost the same length (width) as the photoreceptor 1. The roller 7*b* is positioned with its axis parallel to that of the photoreceptor 1 so that the tips of the brush hair touches the surface of the photoreceptor 1. The brush roller 7*b* is driven to rotate in the opposite direction to the photoreceptor 1. Thus, the roller 7*b* and the photoreceptor 1 slide against each other in the same orientation where they are in contact.

The contact between the brush roller 7*b* and the photoreceptor 1 occurs downstream of the transfer site in terms of the rotation of the photoreceptor 1. The brush roller 7*b* therefore contacts the surface of the photoreceptor 1 to which the toner image has been already transferred. The brush roller 7*b* scrapes the lubricant 7*a* located upstream of its contact with the photoreceptor 1 in terms of the rotation of the brush roller 7*b*, and applies the scraped lubricant to the surface of the photoreceptor 1.

By applying the fine particles in the lubricant 7*a* to the surface of the photoreceptor 1 as above, the brush roller 7*b* lowers the friction between the blade 7*c* and the surface of the photoreceptor 1 and the adhesion of the toner to the surface of the photoreceptor 1. As a result, the blade 7*c* is capable of efficiently removing the toner and eases the wearing of the photoreceptor 1.

Figure 3:
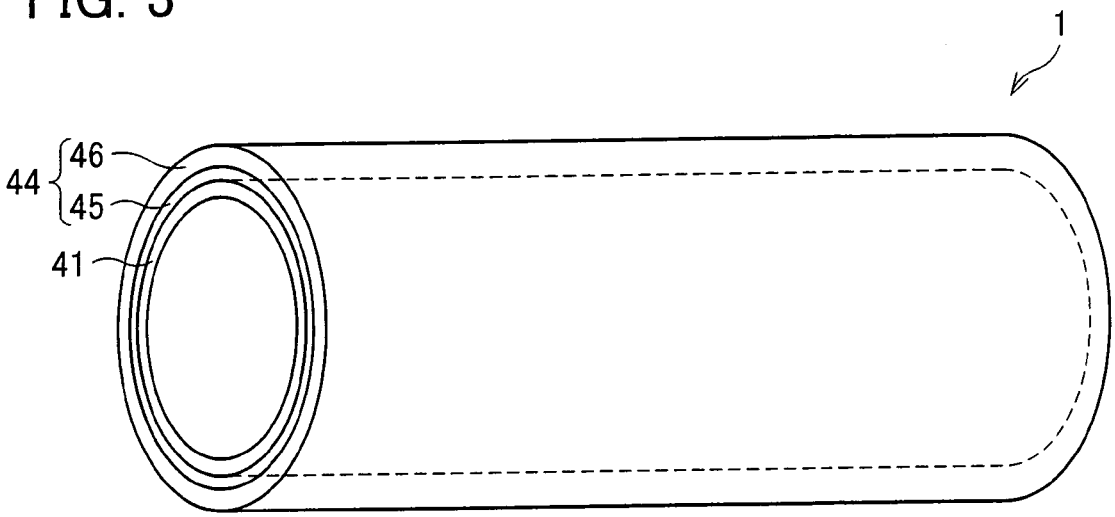
FIG. 3, illustrating an embodiment of the present invention, is an oblique view showing the structure of a photoreceptor.

Now, the structure of the photoreceptor 1 will be described in detail. In the present embodiment, the photoreceptor 1 has a drum shape as shown in FIG. 3 and is made up of a support body 41 and a photosensitive layer 44 formed on the surface of the support body 41.

The support body 41 holds the photosensitive layer 44. The support body 41 may be (a) a metal material, such as aluminum, an aluminum alloy, copper, zinc, stainless steel, or titanium, (b) a polymer material, such as polyethylene terephthalate, polyester, polyoxymethylene, or polystyrene, hard paper, or glass which have its surface laminated with metal foil, which have a metal material vapor-deposited on the surface, or which have a layer of a conductive compound, such as an electrically conductive polymer, tin oxide, indium oxide, carbon particles, or metal particles, vapor-deposited or applied to the surface.

Figure 4:
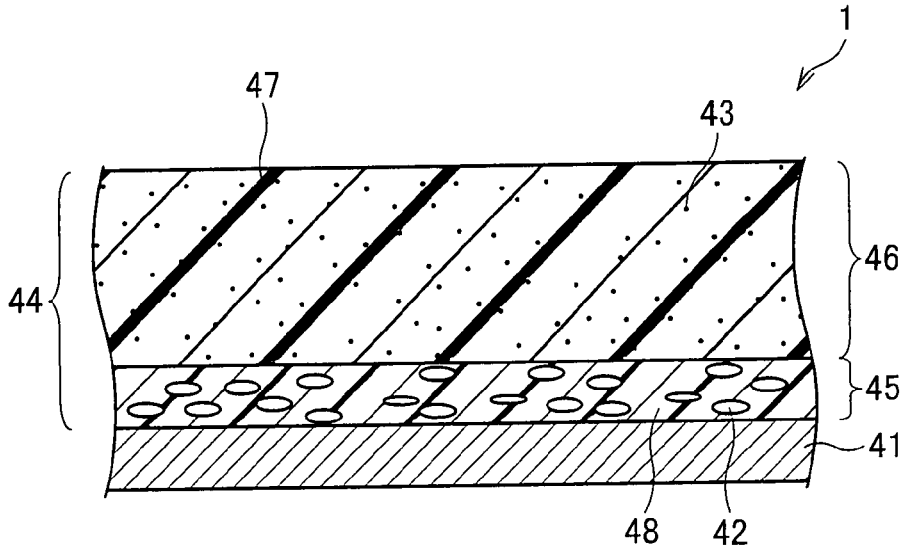
FIG. 4, illustrating an embodiment of the present invention, is a cross-sectional view showing the internal structure of a photoreceptor.

The photosensitive layer 44 is made up, for example, an OPC (organic photoconductor). As shown in FIG. 3, the layer 44 contains in it a charge generating layer 45 and a charge transport layer 46 in this order when viewed from the support body 41. The charge generating layer 45 produces electric charge under light. The charge generating layer 45, as shown in FIG. 4, contains a charge generating material (CGM) 42 which produces electric charge by absorbing light and a binder resin 48 which binds the charge generating material 42.

The charge transport layer 46 receives the charge generated by the charge generating layer 45 and transports it to the surface of the photoreceptor 1. The charge transport layer 46, as shown in FIG. 4, contains a charge transport material (CTM) 43 which transports electric charge and a binder resin 47 which binds the charge transport material 43.

Accordingly, if the photosensitive layer 44 is irradiated with light, electric charge is generated in the irradiated part of the charge generating layer 45. The generated charge is transported to the surface of the photosensitive layer 44 by the charge transport layer 46. As a result, the surface charge of the photosensitive layer 44 is cancelled, thereby forming an electrostatic latent image.

The charge generating material 42 is preferably a substance which produces electric charge under light with wavelengths from 400 to 800 nm. Specific examples include azo compounds, such as bis azo compounds and trisazo compounds; phthalocyanine compounds; squarylium compounds; azulenium compounds; perylene compounds; indigo compounds; polycyclic quinone compounds of quinacridone compounds; cyanine pigments; xanthene dyes; and charge moving complexes, such as poly-N-vinyl carbazole and trinitrofluorenon. These compounds may be used in any combination of two or more of them where necessary. The ratio of the charge generating material 42 to the charge generating layer 45 is preferably 20 to 80% by weight.

The charge transport material 43 may be, for example, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a pyrazoline derivative, an oxazolone derivative, a benzimidazole derivative, a quinazoline derivative, a benzofuran derivative, an acridine derivative, a phenazine derivative, an amino stilbene derivative, a triallylamine derivative, a phenylenediamine derivative, a stilbene derivative, a benzidine derivative, poly-N-vinyl carbazole, poly-1-vinylbilene, or poly-9-vinyl anthracene. These compounds may be used in any combination of two or more of them where necessary. The ratio of the charge transport material 43 to the charge transport layer 46 is preferably 20 to 80% by weight.

The binder resins 47, 48 are, for example, only one resin selected from the group comprising various resins, such as a polyester resin, a polystyrene resin, a polyurethane resin, a phenol resin, an alkyd resin, a melamine resin, an epoxy resin, a silicone resin, an acrylic resin, a methacrylic resin, a polycarbonate resin, a polyarylate resin, a phenoxy resin, a polyvinyl butyral resin, and a polyvinyl formal resin, and copolymer resins containing two or more repeat units of these resins. Alternatively, the binder resins 47, 48 may be two or more resins selected from that group which are used in mixture form. Further, the binder resins 47, 48 may also be, for example, an insulating copolymer resin, such as a vinyl chloride-vinyl acetate copolymer resin, a vinyl chloride-vinyl acetate-maleic anhydride copolymer resin, or an acrylonitrile-styrene copolymer resin.

The photoreceptor 1 is manufactured as follows. The support body 41 is immersed in a charge generating layer solution which contains the charge generating material 42, the binder resin 48, and an organic solvent for the materials so that the solution is applied to the support body 41. The organic solvent is evaporated to form the charge generating layer 45. Then, the support body 41 is immersed in a charge transport layer solution which contains the charge transport material 43, the binder resin 47, and an organic solvent for the materials so that the solution is applied to the support body 41. The organic solvent is evaporated to form the charge transport layer 46.

Figure 1:
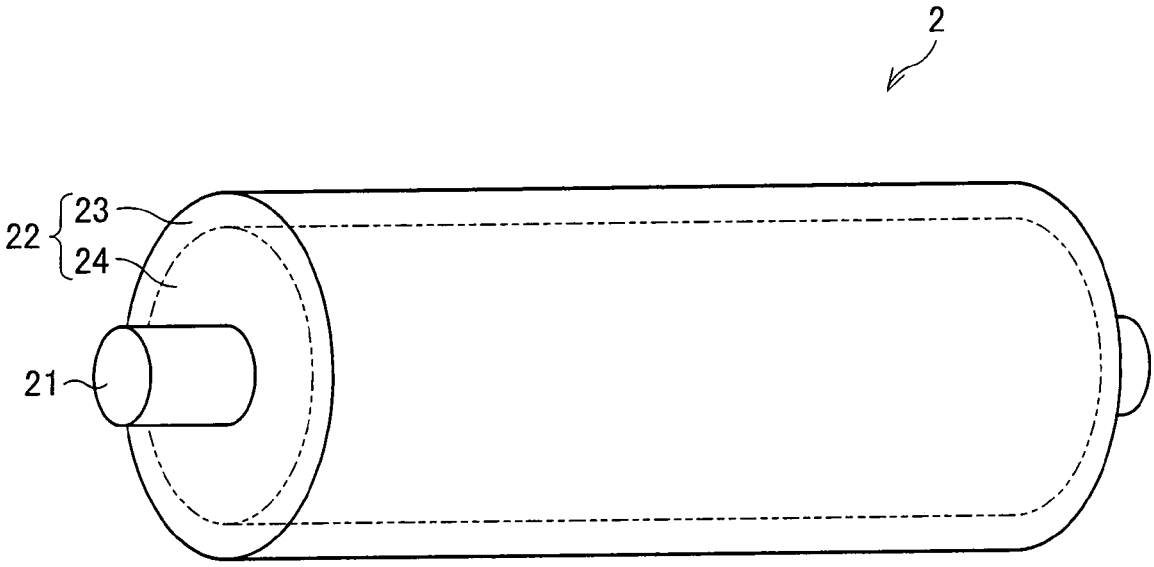
FIG. 1, illustrating an embodiment of the present invention, is an oblique view showing the structure of a charging roller.

Next, the structure of the charging roller 2 will be described in detail. In the present embodiment, the charging roller 2 is shaped like a roller as shown in FIG. 1 and made of a columnar metal core 21 and a rubber layer 22 formed around the core 21. The rubber layer 22 contains a surface processed portion 23 and a non-surface processed portion 24. In the rubber layer 22, the processed portion 23 is located on the surface layer side, and the non-processed portion 24 is located on the metal core 21 side.

The metal core 21 is, for example, stainless steel (SUS) or another electrically conductive metal molded into a bar. A dc voltage is applied to the metal core 21 to charge the photoreceptor 1.

The rubber layer 22 around the metal core 21 is formed from a composition that includes as a base material an epichlorohydrin rubber of either any one or any blend of polymers selected from epichlorohydrin homopolymer, epichlorohydrin-ethylene oxide copolymer, epichlorohydrin-allyl glycidyl ether copolymer, and epichlorohydrin-ethylene oxide-allyl glycidyl ether terpolymer.

The rubber layer 22 of the present embodiment is a hybrid of the epichlorohydrin rubber base material, plus an additional electronic conductive agent and ionic conductive agent. With the addition of these conductive agents, the resistance of the rubber layer 22 can be adjusted to a desired value. The electronic conductive agent added to the rubber base material is, for example, fine powder of: an electrically conductive carbon, such as carbon black, carbon graphite, or carbon nanotube; or an oxide of a metal, such as tin, zinc, or antimony. The ionic conductive agent added to the rubber base material is, for example: an ammonia complex salt or a perchloride of a metal, such as Li, Na, K, Ca, or Mg; sodium acetate trifluoride; or a quaternary ammonium salt. Apart from the rubber base material and the various conductive agents, the rubber layer 22 may also contain a vulcanization accelerator and a crosslinking agent.

The rubber base material containing the various additives is impregnated with a surface processing solution by applying the solution to that material. Then, the material is heated to form the processed portion 23 on the rubber layer 22. The surface processing solution may be applied by any general method, for example, by spraying or dipping. The inside portion of the rubber layer 22, not impregnated with the surface processing solution, is the non-processed portion 24. The processed portion 23 and the non-processed portion 24 have no distinct interface. The surface processing prevents the ionic conductive agent, as an example, from seeping from the rubber layer 22 and contaminating the photoreceptor.

The surface processing solution is a solution containing, for example, an isocyanate compound, an acrylic fluorine-based polymer, or an acrylic silicone-based polymer. A conductive agent such as carbon black may be added where necessary. The isocyanate compound is, for example, 2,6-tolylenediisocyanate (TDI), 4,4'-diphenylmethanediisocyanate (MDI), paraphenylenediisocyanate (PPDI), 1,5-naphthalenediisocyanate (NDI), or 3,3-dimethyldiphenyl-4,4'-diisocyanate (TODI), as well as a multimer or denatured substance of these compounds.

The acrylic fluorine-based polymer and the acrylic silicone-based polymer can be any polymer that is soluble in a predetermined solvent and that forms chemical bonding with the isocyanate compound through reaction. Specifically, the acrylic fluorine-based polymer is a fluorine-based polymer that is soluble in the solvent and that contains a hydroxyl group, an alkyl group, or a carboxyl group. Some of the examples are block copolymers of acrylic esters and fluoroalkyl acrylate and their derivatives. The acrylic silicone-based polymer is a silicone-based polymer that is soluble in a solvent. Some of the examples are block copolymers of acrylic esters and acrylic siloxane esters and their derivatives.

Regarding the rubber layer 22 of the charging roller 2 of the present embodiment, attention should be paid to the fact that the amounts of the electronic conductive agent and ionic conductive agent added are appropriately specified. If an increased amount of the electronic conductive agent is added to reduce the resistance of the rubber layer 22, a small scratch generally tends to lead to current leakage from the charging roller 2 to the photoreceptor 1. In addition, if a dc voltage is applied, the ionic conductive agent is localized due to continuous conduction; the resistance of the non-processed portion 24 tends to increase with operating hours. Under those circumstances, if the resistance of the non-processed portion 24 exceeds that of the processed portion 23, the resistance of the entire charging roller 2 also increases.

Accordingly, in the present embodiment, the amount of the added electronic conductive agent is limited so that a rubber base material which contains no added conductive agent comes to exhibit a volume resistivity of $1.46\times10^6$ Ω·cm or greater (preferably $1.84\times10^6$ Ω·cm or greater) when only the electronic conductive agent is added to the rubber base material. Meanwhile, the amount of the added ionic conductive agent is increased so that the rubber base material to which that amount of the electronic conductive agent has been already added comes to show a volume resistivity of $1.93\times10^6$ Ω·cm or less (preferably $1.46\times10^6$ Ω·cm or less) when the ionic conductive agent is also added to the rubber base material.

As will be further described later by way of examples, the limits on the amount of the added electronic conductive agent so that the volume resistivity reaches $1.46\times10^6$ Ω·cm or greater effectively eases current leakage from the charging roller 2 to the photoreceptor 1. In addition, the rubber layer 22 shows a volume resistivity of $1.93\times10^6$ Ω·cm or less after the addition of both the electronic conductive agent and the ionic conductive agent. Therefore, the non-processed portion 24 after the surface processing also shows a volume resistivity of $1.93\times10^6$ Ω·cm or less. As a result, the non-processed portion 24 has a sufficiently lower resistance than the processed portion 23. Continuous conduction in the charging roller does not localize the ionic conductive agent, still less does it cause the volume resistivity of the non-processed portion 24 to exceed that of the processed portion 23. Therefore, the charging roller 2 (rubber layer 22) overall shows an invariable, stable resistance throughout its life-time.

The minimum amount of the added electronic conductive agent is not limited in any particular manner. As will be further described later by way of examples, there occurs no leakage to the photoreceptor 1 or change in the resistance with operating hours, provided that the agent is added in such an amount that the rubber base material which contains no added conductive agent comes to exhibit a volume resistivity of $5.82\times10^6$ Ω·cm when only the electronic conductive agent is added to the rubber base material.

The maximum amount of the added ionic conductive agent is neither limited in any particular manner. As will be further described later by way of examples, there occurs no leakage to the photoreceptor 1 or change in the resistance with operating hours, provided that the agent is added in such an amount that the rubber base material to which the electronic conductive agent has been already added comes to show a volume resistivity of $7.32\times10^5$ Ω·cm when the ionic conductive agent is also added to the rubber base material.

The current leakage from the charging roller 2 to the photoreceptor 1 depends also on the amount of the applied lubricant 7*a*. The lubricant 7*a*, made of electrically conductive material, tends to cause leakage if the lubricant 7*a* is applied in a large amount. Accordingly, as will be further described later by way of examples, the lubricant 7*a* is supplied to the photoreceptor 1 at a rate of preferably 120 μg or less, and more preferably 100 μg or less, per A4 sized sheet of paper. By so doing, the current leakage to the photoreceptor 1 is more effectively eased. "120 μg or less per A4-sized sheet of paper" means that the amount of the lubricant applied to the photoreceptor 1 when an image is to be formed on a A4-sized sheet of paper is 120 μg or less. The lubricant is not necessarily applied to the photoreceptor 1 every time a page is printed. The lubricant may be applied once for a few pages in a corresponding amount.

As described in the foregoing, the charging roller of the present embodiment is made of a metal core (conductive support body) 21 and a rubber layer (resistive layer) 22 formed on the metal core 21. The roller can be manufactured by a rubber layer formation step (resistive layer formation step) and a surface processing step. In the rubber layer formation step, the electronic conductive agent and the ionic conductive agent are added in a first addition amount and a second addition amount respectively to the rubber base material that contains no added conductive agent, so as to form a conductive agent-containing rubber layer on the metal core 21. In the surface processing step, the surface of the conductive agent-containing rubber layer formed in the rubber layer formation step is hardened. It should be noted that the first addition amount is limited so that the volume resistivity is $1.46\times10^6$ Ω·cm or greater when only the first addition amount of the electronic conductive agent is added to the rubber base material and also that the second addition amount is increased so that the volume resistivity is $1.93\times10^6$ Ω·cm or less when the first addition amount of the electronic conductive agent and the second addition amount of the ionic conductive agent are added to the rubber base material.

EXAMPLES

Next, examples of the invention will be described which were conducted to verify effects of the present invention. In the examples, we changed the amounts of the electronic conductive agent and the ionic conductive agent added to the rubber layer 22 of the charging roller 2 and the amount of the lubricant 7*a* applied, and examined (1) whether there occurred current leakage to the photoreceptor 1 and (2) whether the resistance of the charging roller 2 was stable throughout its life-time.

Comparative Example 1

In the present comparative example, the metal core 21 was a SUS bar 8 mm in diameter. The rubber base material for the rubber layer 22 was an epichlorohydrin rubber. Only a predetermined amount of an electronic conductive agent alone that contained carbon black as a primary component was kneaded into the rubber base material. The result was spread on the metal core 21 to fabricate a pseudo charging roller 12 with a rubber layer 22 that neither contained an electronic conductive agent nor had been subjected to any surface processing. The surface was polished to reduce the external diameter of the rubber layer 22 to 21 mm. The resistance of the pseudo charging roller 12 was measured by the method depicted in FIG. 5.

Specifically, in the present comparative example, the pseudo charging roller 12 was brought into contact with an electrically conductive base body 11 measuring 80 mm in diameter that resembled the photoreceptor 1. The pseudo charging roller 12 was pressed against the conductive base body 11 with a 650-gram load which was the result of the weight of the pseudo charging roller 12 itself (=250 g) and forces from two springs, each exerting 200 g of force. Next, the conductive base body 11 was rotated, which in turn caused the pseudo charging roller 12 to rotate. In that state, a predetermined constant dc voltage was applied from a voltage application device 13 to the pseudo charging roller 12. At the same time, electric current was measured with an ammeter 14. The resistance was calculated to be $10^{5.2}$Ω from the measurement (see Table 1 below).

Next, the volume resistivity of the pseudo charging roller 12 was calculated from the calculated resistance value. The volume resistivity Rv (Ω·cm) is given by equation (1):

$$Rv=Ra\times L\times W/t \quad (1)$$

where Ra (Ω) is the resistance, L (cm) is the length of the rubber layer 22 in the longitudinal direction, W (cm) is the nip width between the pseudo charging roller 12 and the conductive base body 11, and t (cm) is the thickness of the rubber layer 22. In the present comparative example, L=30 cm, W=0.1 cm, and t=0.65 cm. So, equation (2) was used to calculate the volume resistivity from the resistance:

$$Rv=4.62\times Ra \quad (2)$$

The volume resistivity of the charging roller 2 after only the electronic conductive agent had been added was $7.32\times10^5$ Ω·cm in the present comparative example (see Table 1 below).

The same amount (mixing ratio) of the electronic conductive agent was added to the same rubber base material as above. Apart from that, an ionic conductive agent that contained lithium perchloride as a primary component was kneaded into the rubber base material. Another pseudo charging roller 12 was thus fabricated with a rubber layer 22 that contained both the electronic conductive agent and the ionic conductive agent, but had not been subjected to surface processing. The resistance of the fabricated pseudo charging roller 12 was measured, and the volume resistivity was obtained, by the same method as above. The resistance was $10^{5.15}$Ω, and the volume resistivity was $5.82\times10^5$ Ω·cm (see Table 1 below).

Figure 5:
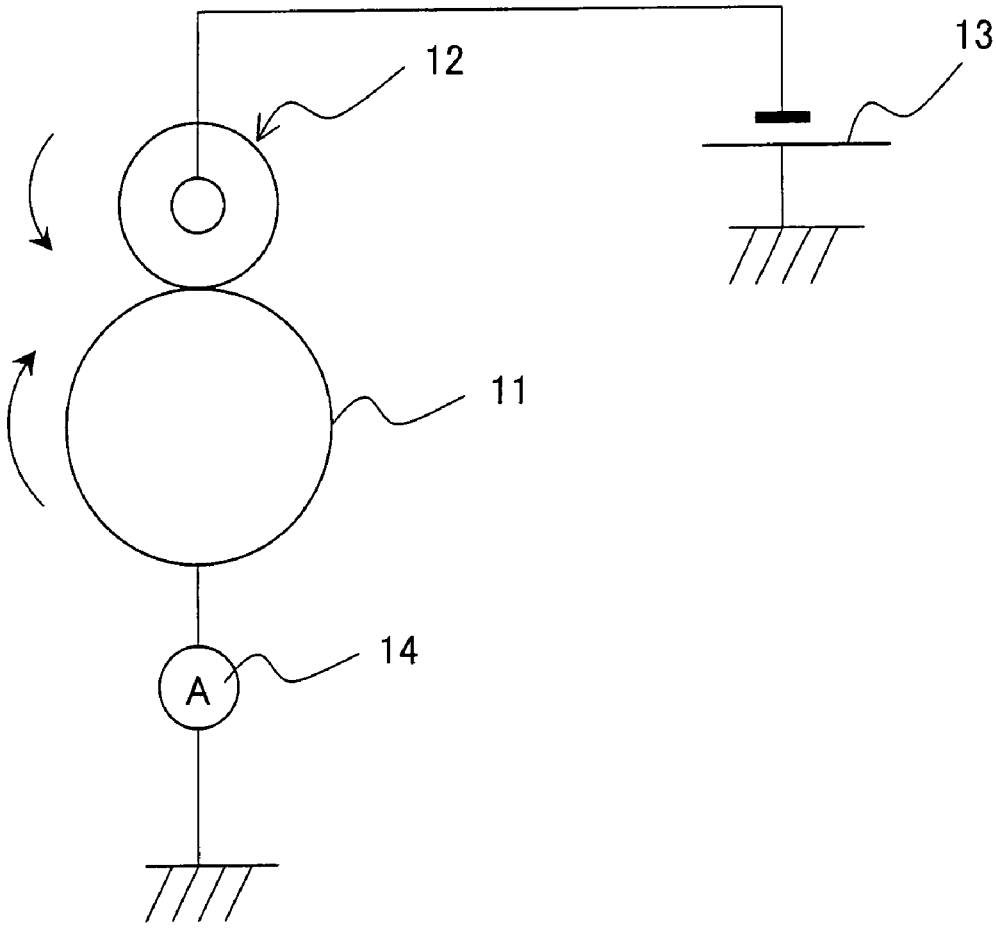
FIG. 5 is a schematic diagram showing a method of measuring the resistance of a charging roller.

Now, the pseudo charging roller 12 and the real photoreceptor drum 1 were mounted to the system shown in FIG. 5. It was then examined whether there occurred current leakage to the photoreceptor 1 from the pseudo charging roller 12 to which a constant dc voltage (maximum −3.0 kV) was being applied whilst the roller 12 and the drum 1 were being rotated at the same rate as in an actual image forming apparatus (process speed=395 mm/s). The rubber layer 22 of the pseudo charging roller 12 had not been subjected to surface processing, in order to conduct an experiment assuming that the effect of the surface processing had been partly lost over time.

No lubricant 7*a* was applied to the surface of the photoreceptor 1 in the present comparative example. No leakage was observed even when a −3.0 kV voltage was applied (see Table 1 below).

Thereafter, this pseudo charging roller 12, containing the electronic conductive agent and the ionic conductive agent, was subjected to surface processing in which the layer 22 was heated after having been sprayed with a surface processing solution containing an isocyanate compound, an acrylic fluorine-based polymer, and an acrylic silicone-based polymer using a spray. Thus, another charging roller 2 was fabricated. After the surface processing, the hardness of the surface of the rubber layer 22 was measured using a Teclock Durometer GS-719 G (manufactured by Teclock Co., Ltd.). The result was 35° in terms of the JIS-A Standard. The resistance of the processed portion 23 of the charging roller 2 was $10^6\Omega$. The examples and comparative examples below are all designed to deliver a rubber layer 22 with the same surface hardness and a processed portion 23 with the same resistance as set out here.

The surface processed charging roller 2 was subjected to a non-printing rotation aging test in which the roller 2 was rotated as many times as it would have been in a 300,000 page printing job, to examine whether the overall resistance of the charging roller 2 would change. The resistance showed no notable changes and stayed at $10^6\Omega$ (see Table 1 below).

Comparative Example 2

The present comparative example involved a pseudo charging roller 12 which was identical to the one used in comparative example 1: the roller 12 contained the electronic conductive agent and the ionic conductive agent, but had not been subjected to surface processing. A lubricant 7*a* of zinc stearate was applied to the surface of the photoreceptor 1. It was then examined whether there occurred current leakage from the pseudo charging roller 12 to the photoreceptor 1. The amount of the lubricant applied was 100 μg per A4-sized sheet of paper in the present comparative example. This amount was calculated by dividing lubricant consumption by the number of A4-sized pages printed. The other conditions were the same as in comparative example 1. No leakage was observed even when a −3.0 kV voltage was applied (see Table 1 below).

Comparative Example 3

The present comparative example involved a pseudo charging roller 12 which was identical to the ones used in comparative examples 1, 2: the roller 12 contained the electronic conductive agent and the ionic conductive agent, but had not been subjected to surface processing. A lubricant was applied to the surface of the photoreceptor 1 at a rate of 120 μg per A4-sized sheet of paper. It was then examined whether there occurred current leakage from the pseudo charging roller 2 to the photoreceptor 1. The other conditions were the same as in comparative example 1. Leakage occurred under an applied voltage of −2.5 kV or below (see Table 1 below).

Example 1

The electronic conductive agent was added in a less amount in the present example than in comparative example 1. The resultant pseudo charging roller 12, containing only the electronic conductive agent, had a resistance of $10^{5.5}\Omega$ and a volume resistivity of $1.46\times10^6$ Ω·cm (see Table 1 below).

Next, another pseudo charging roller 12 was fabricated which contained the aforementioned amount of the electronic conductive agent and a predetermined amount of the ionic conductive agent. The resistance and volume resistivity of the pseudo charging roller 12 were calculated to be $10^{5.4}\Omega$ and $1.16\times10^6$ Ω·cm respectively (see Table 1 below).

It was examined, similarly to comparative example 3, whether or not there occurred current leakage to the photoreceptor 1 from this pseudo charging roller 12 containing the electronic conductive agent and the ionic conductive agent, but not having been subjected to surface processing. The examination was performed with the lubricant being applied to the surface of the photoreceptor 1 at a rate of 120 μg per A4-sized sheet of paper. Leakage occurred under an applied voltage of −2.5 to −3.0 kV (see Table 1 below).

Next, this pseudo charging roller 12 containing the electronic conductive agent and the ionic conductive agent was subjected to surface processing similarly to comparative example 1 to fabricate another charging roller 2. The charging roller 2 was then subjected to the same 300,000 page-equivalent non-printing rotation aging test as in comparative example 1, to examine whether the overall resistance of the charging roller 2 would change. The resistance showed no notable changes and stayed at 106Ω (see Table 1 below).

Example 2

The electronic conductive agent was added in an even less amount in the present example than in example 1. The resultant pseudo charging roller 12, containing only the electronic conductive agent, had a resistance of $10^{5.6}\Omega$ and a volume resistivity of $1.84\times10^6$ Ω·cm (see Table 1 below).

Next, another pseudo charging roller 12 was fabricated which contained the aforementioned amount of the electronic conductive agent and a predetermined amount of the ionic conductive agent. The resistance and volume resistivity of the pseudo charging roller 12 were calculated to be $10^{5.48}\Omega$ and $1.40\times10^6$ Ω·cm respectively (see Table 1 below).

It was examined, similarly to comparative example 3, whether or not there occurred current leakage to the photoreceptor 1 from this pseudo charging roller 12 containing the electronic conductive agent and the ionic conductive agent, but not having been subjected to surface processing. The examination was performed with the lubricant being applied to the surface of the photoreceptor 1 at a rate of 120 μg per A4-sized sheet of paper. No leakage was observed even when a −3.0 kV voltage was applied (see Table 1 below).

Next, this pseudo charging roller 12 containing the electronic conductive agent and the ionic conductive agent was subjected to surface processing similarly to comparative example 1 to fabricate another charging roller 2. The charging roller 2 was then subjected to the same 300,000 page-equivalent non-printing rotation aging test as in comparative example 1, to examine whether the overall resistance of the charging roller 2 would change. The resistance showed no notable changes and stayed at $10^6\Omega$ (see Table 1 below).

Example 3

The electronic conductive agent was added in an even less amount in the present example than in example 2. The resultant pseudo charging roller 12, containing only the electronic conductive agent, had a resistance of $10^{5.8}\Omega$ and a volume resistivity of $2.92\times10^6$ Ω·cm (see Table 1 below).

Next, another pseudo charging roller 12 was fabricated which contained the aforementioned amount of the electronic conductive agent and a predetermined amount of the ionic conductive agent. The resistance and volume resistivity of the pseudo charging roller 12 were calculated to be $10^{5.5}\Omega$ and $1.46\times10^{6}$ Ω·cm respectively (see Table 1 below).

It was examined, similarly to comparative example 3, whether or not there occurred current leakage to the photoreceptor 1 from this pseudo charging roller 12 containing the electronic conductive agent and the ionic conductive agent, but not having been subjected to surface processing. The examination was performed with the lubricant being applied to the surface of the photoreceptor 1 at a rate of 120 μg per A4-sized sheet of paper. No leakage was observed even when a −3.0 kV voltage was applied (see Table 1 below).

Next, this pseudo charging roller 12 containing the electronic conductive agent and the ionic conductive agent was subjected to surface processing similarly to comparative example 1 to fabricate another charging roller 2. The charging roller 2 was then subjected to the same 300,000 page-equivalent non-printing rotation aging test as in comparative example 1, to examine whether the overall resistance of the charging roller 2 would change. The resistance showed no notable changes and stayed at $10^{6}\Omega$ (see Table 1 below).

Example 4

The electronic conductive agent was added in an even less amount in the present example than in example 3. The other conditions were the same as in comparative example 1. The resultant pseudo charging roller 12, containing only the electronic conductive agent, had a resistance of $10^{6.1}\Omega$ and a volume resistivity of $5.82\times10^{6}$ Ω·cm (see Table 1 below).

Next, another pseudo charging roller 12 was fabricated which contained the aforementioned amount of the electronic conductive agent and a predetermined amount of the ionic conductive agent. The resistance and volume resistivity of the pseudo charging roller 12 were calculated to be $10^{5.2}\Omega$ and $7.32\times10^{5}$ Ω·cm respectively (see Table 1 below).

It was examined, similarly to comparative example 3, whether or not there occurred current leakage to the photoreceptor 1 from this pseudo charging roller 12 containing the electronic conductive agent and the ionic conductive agent, but not having been subjected to surface processing. The examination was performed with the lubricant being applied to the surface of the photoreceptor 1 at a rate of 120 μg per A4-sized sheet of paper. No leakage was observed even when a −3.0 kV voltage was applied (see Table 1 below).

Next, this pseudo charging roller 12 containing the electronic conductive agent and the ionic conductive agent was subjected to surface processing similarly to comparative example 1 to fabricate another charging roller 2. The charging roller 2 was then subjected to the same 300,000 page-equivalent non-printing rotation aging test as in comparative example 1, to examine whether the overall resistance of the charging roller 2 would change. The resistance showed no notable changes and stayed at $10^{6}\Omega$ (see Table 1 below).

Example 5

In the present example, the electronic conductive agent was added in the same amount as in example 4, and the ionic conductive agent was added in a less amount than in example 4. The resultant pseudo charging roller 12, containing the electronic conductive agent and the ionic conductive agent, but not having been subjected to surface processing, had a resistance of $10^{5.62}\Omega$ and a volume resistivity of $1.93\times10^{6}$ Ω·cm (see Table 1 below).

It was examined, similarly to comparative example 3, whether or not there occurred current leakage to the photoreceptor 1 from this pseudo charging roller 12 containing the electronic conductive agent and the ionic conductive agent, but not having been subjected to surface processing. The examination was performed with the lubricant being applied to the surface of the photoreceptor 1 at a rate of 120 μg per A4-sized sheet of paper. No leakage was observed even when a −3.0 kV voltage was applied (see Table 1 below).

Next, this pseudo charging roller 12 containing the electronic conductive agent and the ionic conductive agent was subjected to surface processing similarly to comparative example 1 to fabricate another charging roller 2. The charging roller 2 was then subjected to the same 300,000 page-equivalent non-printing rotation aging test as in comparative example 1, to examine whether the overall resistance of the charging roller 2 would change. The resistance showed a small change (=$10^{6}$ to $10^{6.2}\Omega$) (see Table 1 below).

Comparative Example 4

In the present comparative example, the electronic conductive agent was added in the same amount as in examples 4, 5, and the ionic conductive agent was added in an even less amount than in example 5. The resultant pseudo charging roller 12, containing the electronic conductive agent and the ionic conductive agent in the rubber base material, but not having been subjected to surface processing, had a resistance of $10^{5.8}\Omega$ and a volume resistivity of $2.92\times10^{6}$ Ω·cm (see Table 1 below).

It was examined, similarly to comparative example 3, whether or not there occurred current leakage to the photoreceptor 1 from this pseudo charging roller 12 containing the electronic conductive agent and the ionic conductive agent, but not having been subjected to surface processing. The examination was performed with the lubricant being applied to the surface of the photoreceptor 1 at a rate of 120 μg per A4-sized sheet of paper. No leakage was observed even when a −3.0 kV voltage was applied (see Table 1 below).

Next, this pseudo charging roller 12 containing the electronic conductive agent and the ionic conductive agent was subjected to surface processing similarly to comparative example 1 to fabricate another charging roller 2. The charging roller 2 was then subjected to the same 300,000 page-equivalent non-printing rotation aging test as in comparative example 1, to examine whether the overall resistance of the charging roller 2 would change. The resistance showed a large change, increasing $10^{6.2}\Omega$ or greater (see Table 1 below).

TABLE 1

| | Common Logarithm of Resistance in Ω (Volume Resistivity Ω · cm) | | | | | |
|---|---|---|---|---|---|---|
| | Before Surface Processing | | After | Application of ZnSt (μg/A4 page) | Leakage | Stability through Life |
| | Electronic Conductive Agent Only | Ionic Conductive Agent Added | Surface Processing | | | |
| Com. Ex. 1 | 5.2 ($7.32\times10^{5}$) | 5.15 ($6.53\times10^{5}$) | 6 | 0 | Good | Good |
| Com. Ex. 2 | 5.2 ($7.32\times10^{5}$) | 5.15 ($6.53\times10^{5}$) | 6 | 100 | Good | Good |
| Com. Ex. 3 | 5.2 ($7.32\times10^{5}$) | 5.15 ($6.53\times10^{5}$) | 6 | 120 | Bad | Good |
| Ex. 1 | 5.5 ($1.46\times10^{6}$) | 5.4 ($1.16\times10^{6}$) | 6 | 120 | Fair | Good |

TABLE 1-continued

| | Common Logarithm of Resistance in Ω (Volume Resistivity Ω · cm) | | | | | |
|---|---|---|---|---|---|---|
| | Before Surface Processing | | After | Applica- | | |
| | Electronic Conductive Agent Only | Ionic Conductive Agent Added | Surface Process-ing | tion of ZnSt (μg/ A4 page) | Leak-age | Stability through Life |
| Ex. 2 | 5.6 ($1.84 \times 10^6$) | 5.48 ($1.40 \times 10^6$) | 6 | 120 | Good | Good |
| Ex. 3 | 5.8 ($2.92 \times 10^6$) | 5.5 ($1.46 \times 10^6$) | 6 | 120 | Good | Good |
| Ex. 4 | 6.1 ($5.82 \times 10^6$) | 5.2 ($7.32 \times 10^5$) | 6 | 120 | Good | Good |
| Ex. 5 | 6.1 ($5.82 \times 10^6$) | 5.62 ($1.93 \times 10^6$) | 6 | 120 | Good | Fair |
| Com. Ex. 4 | 6.1 ($5.82 \times 10^6$) | 5.8 ($2.92 \times 10^6$) | 6 | 120 | Good | Bad |

In the "Leakage" column in Table 1, "Good" indicates that there occurred no leakage at all even at −3.0 kV. "Fair" indicates that there occurred leakage at −2.5 to −3.0 kV. "Bad" indicates that there occurred leakage at less than or equal to −2.5 kV. In the "Life-time Stability" column, "Good" indicates that the overall resistance of the charging roller 2 stayed at $10^6\Omega$ and did not show any change. "Fair" indicates that the overall resistance of the charging roller 2 changed only slightly to $10^6$ to $10^{6.2}\Omega$. "Bad" indicates that the overall resistance of the charging roller 2 changed greatly to more than or equal to $10^{6.2}\Omega$.

CONCLUSION

The results obtained from the examples presented above demonstrate that to prevent current leakage to the photoreceptor 1, the electronic conductive agent is added in such an amount that the pseudo charging roller 12 in which only the electronic conductive agent has been added to the rubber base material exhibits a pre-surface processing volume resistivity of preferably $1.46\times10^6$ Ω·cm or greater, and more preferably $1.84\times10^6$ Ω·cm or greater.

It is also demonstrated that to render the resistance of the charging roller 2 stable throughout its life-time, the ionic conductive agent is added in such an amount that the pseudo charging roller 12 in which both the electronic conductive agent and the ionic conductive agent have been added to the rubber base material exhibits a pre-surface processing volume resistivity of preferably $1.93\times10^6$ Ω·cm or less, and more preferably $1.46\times10^6$ Ω·cm or less.

It is also demonstrated that to prevent current leakage to the photoreceptor 1, the lubricant is applied at a rate of preferably 120 μg or less, and more preferably 100 μg or less, per A4-sized sheet of paper.

The embodiments and examples are for illustrative purposes only and by no means limit the scope of the present invention. Variations are not to be regarded as a departure from the spirit and scope of the invention, and all such modifications as would be obvious to one skilled in the art are intended to be included within the scope of the claims below.

As described in the foregoing, in the charging roller and the image forming apparatus in accordance with the present invention, the electronic conductive agent and the ionic conductive agent are added to the rubber base material in the first addition amount and the second addition amount respectively. The volume resistivity is $1.46\times10^6$ Ω·cm or greater when only the electronic conductive agent has been added to the rubber base material in the first addition amount. Furthermore, the volume resistivity is $1.93\times10^6$ Ω·cm or less when the electronic conductive agent and the ionic conductive agent have been added to the rubber base material in the first addition amount and the second addition amount respectively.

Therefore, as mentioned earlier, the current leakage to the image carrier is prevented throughout life-time, and the resistance is stable throughout life-time.

The hardening mentioned earlier may be carried out by applying a solution containing an isocyanate compound to the surface of the rubber layer to which the conductive agents have been added and then heating the layer. Besides, the rubber base material is preferably an epichlorohydrin rubber.

The image forming apparatus preferably further includes lubricant supplier for supplying the lubricant to the surface of the image carrier.

According to the structure, the lubricant is supplied to the surface of the image carrier. The substance which may stick to the surface of the image carrier can be readily removed. As a result, the charging roller shows improved charging performance, for example. An especially suitable lubricant is zinc stearate.

The lubricant supplier preferably supplies the lubricant to the surface of the image carrier at a rate of 120 μg or less per A4-sized sheet of paper on which the image is formed According to the structure, the supply of the lubricant is limited to 120 μg or less per A4-sized sheet of paper on which the image is formed. Even if the lubricant is electrically conductive, the current leakage to the image carrier is reliably prevented.

The present invention delivers a charging roller which is capable of preventing the current leakage to the photoreceptor and which has a stable resistance value throughout its life-time. The present invention is therefore suitably applicable to electrophotographic image forming apparatus.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A charging roller, comprising a conductive support body and a resistive layer formed on the conductive support body, the resistive layer being formed by hardening a surface of a conductive agent-containing rubber layer formed by adding an electronic conductive agent and an ionic conductive agent to a rubber base material to which no conductive agents have been added forming a surface on the rubber base material comprising an electronic conductive agent and an ionic conductive agent and then molding the rubber base material, a first addition amount which is an amount of the electronic conductive agent added to the rubber base material being such that a volume resistivity when only the first addition amount of the electronic conductive agent has been added to the rubber base material is $1.46\times10^6$ Ω·cm or greater, and a second addition amount which is an amount of the ionic conductive agent added to the rubber base material being such that a volume resistivity when the first addition amount of the electronic conductive agent and the second addition amount of the ionic conductive agent have been added to the rubber base material is $1.93\times10^6$ Ω·cm or less.

2. The charging roller of claim 1, wherein the hardening is carried out by applying a solution containing an isocyanate compound to the surface of the rubber layer to which the conductive agents have been added and then heating the layer.

3. The charging roller of claim 2, wherein the rubber base material is an epichlorohydrin rubber.

4. An image forming apparatus, comprising:

an image carrier for carrying an electrostatic latent image; and a charging roller for charging the image carrier, the charging roller including a conductive support body and a resistive layer formed on the conductive support body, the resistive layer contacting a surface of the image carrier, the resistive layer being formed by hardening a surface of a conductive agent-containing rubber layer formed by adding an electronic conductive agent and an ionic conductive agent to a rubber base material to which no conductive agents have been added forming a surface on the rubber base material comprising an electronic conductive agent and an ionic conductive agent and then molding the rubber base material, a first addition amount which is an amount of the electronic conductive agent added to the rubber base material being such that a volume resistivity when only the first addition amount of the electronic conductive agent has been added to the rubber base material is $1.46\times10^{6}$ Ω·cm or greater, and a second addition amount which is an amount of the ionic conductive agent added to the rubber base material being such that a volume resistivity when the first addition amount of the electronic conductive agent and the second addition amount of the ionic conductive agent have been added to the rubber base material is $1.93\times10^{6}$ Ω·cm or less.

5. The image forming apparatus of claim 4, further comprising lubricant supplier for supplying a lubricant to the surface of the image carrier.

6. The image forming apparatus of claim 5, wherein the lubricant supplier supplies the lubricant to the surface of the image carrier at a rate of 120 μg or less per A4-sized sheet of paper on which an image is formed.

7. The image forming apparatus of claim 6, wherein the lubricant is zinc stearate.

* * * * *